US006623322B1

(12) United States Patent
Lesniak

(10) Patent No.: US 6,623,322 B1
(45) Date of Patent: Sep. 23, 2003

(54) INFLATABLE DINGHY COVER

(76) Inventor: Steve A. Lesniak, P.O. Box 20043, Charleston, SC (US) 29413

( * ) Notice: Subject to any disclaimer, the term of this patent is extended or adjusted under 35 U.S.C. 154(b) by 0 days.

(21) Appl. No.: 10/141,157

(22) Filed: May 8, 2002

(51) Int. Cl.[7] ..... B63B 35/58
(52) U.S. Cl. ..... 441/38; 114/345; 114/361
(58) Field of Search ..... 441/35, 38, 40; 114/345, 361; 135/88.01, 88.03, 88.13, 88.15

(56) References Cited

U.S. PATENT DOCUMENTS

| | | | | |
|---|---|---|---|---|
| 3,843,983 | A | | 10/1974 | Tangen |
| 4,251,959 | A | | 2/1981 | Hsu |
| 4,678,443 | A | | 7/1987 | Edwards et al. |
| 4,766,918 | A | | 8/1988 | Odekirk |
| 4,828,520 | A | * | 5/1989 | Baughman et al. ..... 441/40 |
| 4,998,900 | A | | 3/1991 | Wright |
| 5,921,830 | A | | 7/1999 | Shoaff, III |
| 5,987,822 | A | | 11/1999 | McNiff et al. |
| 6,179,367 | B1 | | 1/2001 | Bowen |
| 6,192,633 | B1 | | 2/2001 | Hilbert |
| 6,206,743 | B1 | | 3/2001 | Martin |

* cited by examiner

*Primary Examiner*—Ed Swinehart
(74) *Attorney, Agent, or Firm*—Harleston Law Firm LLC; Kathleen M. Harleston

(57) ABSTRACT

An easily inflated cover protecting occupants of a small vessel, preferably an inflatable dinghy, includes:

(a) a flexible canopy comprised of a central canopy portion having side edges for contacting opposite sides of the vessel, a forward canopy portion having a lower edge for contacting a bow of the vessel, the forward canopy portion extending from one side of the central canopy portion, and an aft entrance portion connected to an opposite side of the central canopy portion; the aft entrance portion including an opening to an interior of the vessel;

(b) a system of spaced-apart, flexible straps attachable across a bottom of the vessel for affixing the cover to the vessel, the strap system including a connector strap, the connector strap being detachably or permanently attached at its ends to two, opposite, lower edges of the canopy; and (c) at least one inflatable central support for supporting the canopy over the vessel interior, the inflatable support including an enclosed, inflatable support tube and an air valve in the support tube for inflating it; and wherein the inflatable support tube lies beneath and adjacent to a portion of the canopy, and the cover is removably attachable over the bow and sides of the vessel.

15 Claims, 7 Drawing Sheets

INFLATABLE DINGHY COVER

BACKGROUND OF THE INVENTION

1. Technical Field

The present invention relates to a lightweight, stowable cover, with an easily inflatable support, for protecting occupants of a dinghy or other small vessel on the water.

2. Background Information

Many sailboats, yachts, power boats, fishing boats and other types of "primary" vessels carry or pull an dinghy, which is used as a runabout, tender, or as a life raft in the event of an emergency. If the primary vessel capsizes, its occupants can flee in the inflated dinghy. A covered dinghy or life raft is advantageous because it protects against wind and sun exposure, which can make the difference between life and death in the event abandonment of a primary vessel becomes necessary. Such a cover could also be used on a dinghy, with or without an outboard motor or steering wheel, that is used by itself as a small fun boat. Such a cover would also protect the dinghy's occupants against salt water spray and cold ambient temperatures. However, an effective, lightweight dinghy cover that can quickly be erected in the event of an emergency has. not been available heretofore.

The cover of the present invention protects the dinghy's occupants from wind and sun exposure, spray, and cold ambient temperatures. Besides protecting the dinghy's occupants, this brightly colored cover is highly visible and facilitates recovery of the dinghy. Even with the cover on, the dinghy can provide a stable ride. The erect cover does not interfere with handling of the dinghy. The cover of the present invention does not take up valuable dinghy floor space.

The dinghy cover of the present invention can quickly and easily be erected before or after boarding the dinghy and is also easily disassembled, folded, and stored in an attached storage pouch. The cover can be assembled and disassembled quickly by one person. It can be erected on land, on the deck of the primary vessel, or in the dinghy.

BRIEF SUMMARY OF THE INVENTION

The present invention is a cover with an easily inflated support for protecting occupants of a dinghy or other small vessel, including:

(a) a flexible canopy comprised of a central canopy portion having side edges for contacting opposite sides of the vessel, a forward canopy portion having a lower edge for contacting a bow of the vessel, the forward canopy portion extending from one side of the central canopy portion, and an aft entrance portion connected to an opposite side of the central canopy portion; the aft entrance portion comprising an opening to an interior of the vessel;

(b) a system of spaced-apart, flexible straps attachable across a bottom of the vessel for affixing the cover to the vessel, the strap system comprising at least one connector strap, the connector strap being detachably or permanently attached at its ends to two, opposite, lower edges of the canopy; and (c) at least one inflatable central support for supporting the canopy over the vessel interior, the inflatable support comprising at least one enclosed, inflatable support tube and an air valve in the support tube for inflating the support tube; and wherein the inflatable support tube lies beneath and adjacent to a portion of the canopy, and the cover is removably attachable over the bow and sides of the vessel. The cover preferably also includes ties, each affixed at one end to an inside face of the canopy, for tying the canopy to tie holds in the vessel.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

BRIEF LIST OF REFERENCE NUMBERS USED IN THE DRAWINGS

Figure 1:
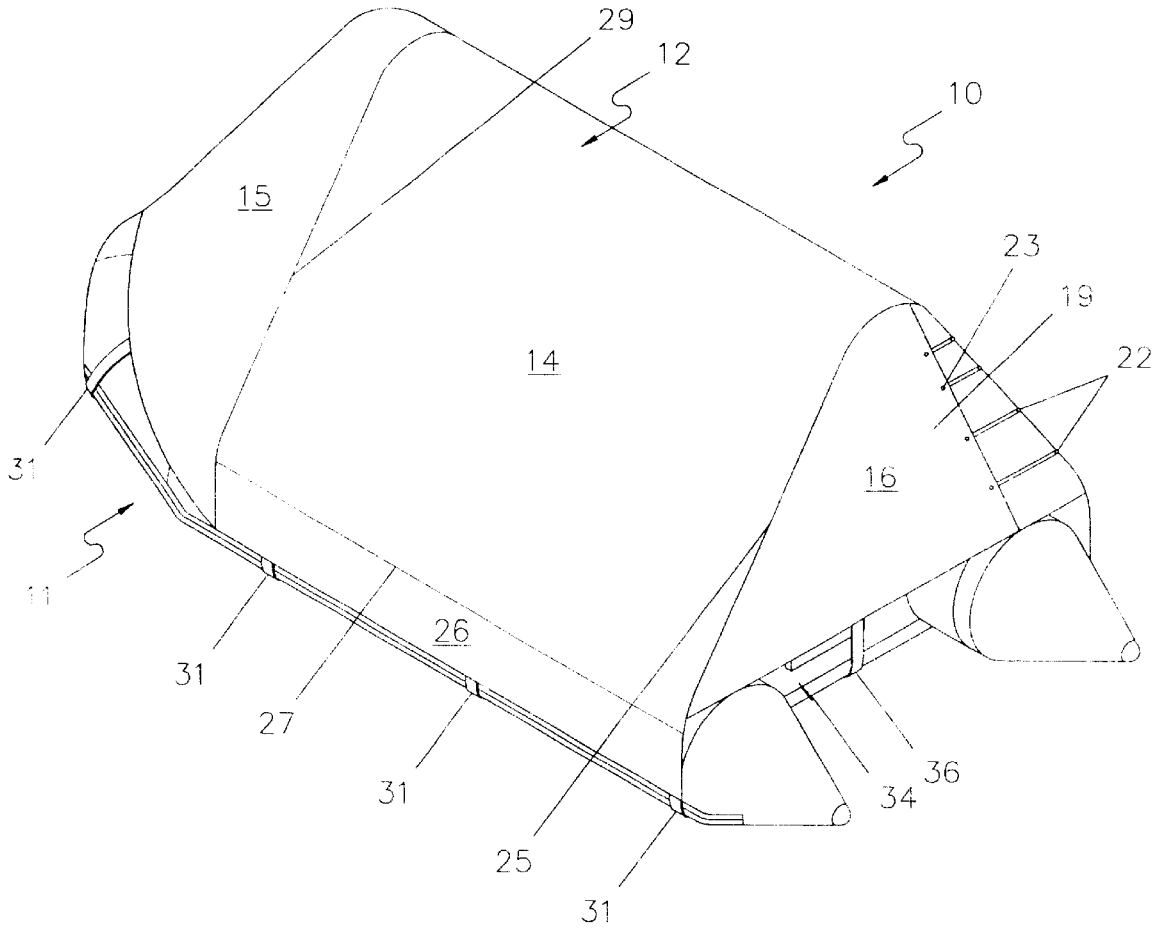
FIG. 1 shows a rear perspective view of a dinghy cover according to the present invention, shown on a dinghy.

10 dinghy cover
11 dinghy
12 canopy
13 canopy support
14 central canopy portion
15 forward canopy portion
16 aft entrance portion
17 opening
18 interior of canopy
19 door flap
20 dinghy seat
21 oar lock
22 door flap tie
23 grommet
24 door lashing
25 canopy first seam

26 canopy side borders
27 canopy second seams
28 dinghy bow
29 canopy third seam
30 strap system
31 connector strap
32 main strap
33 hook
34 dinghy stern board
35 front end of main strap
36 rear end of main strap
37 carabiner
38 loop
39 forward window
40 string tie
41 interior seam for string ties
42 hook and loop patches on dinghy
43 corresponding hook and loop on canopy
44 inflatable support
45 central support tube
46 air valve
47 front portion of support
48 leg tube portions
49 rear pair of leg tube portions
50 front pair of leg tube portions
51 canopy straps
52 hook and loop strips for straps
53 side edge of flap
54 adjoining side edge
55 opening of flap
56 remainder of the cover
57 hook and loop strips on flap
58 section of material
59 front wall of flap
60 rear wall of flap

DETAILED DESCRIPTION OF THE INVENTION

In the following description, like reference characters designate like or corresponding parts throughout the several views. Also, in the following description, it is to be understood that such terms as "front," "rear," "within," and the like are words of convenience and are not to be construed as limiting terms. Referring in more detail to the drawings, the invention will now be described.

Turning first to FIG. 1, an inflatable cover, generally referred to as 10, according to the present invention is shown detachably affixed to a dinghy 11. Although it is designed for use on inflatable dinghies in particular, the cover 10 is adaptable for attachment to any type of small vessel, including runabouts and life rafts. The cover 10 protects occupants of the dinghy against wind and sun exposure, which can make the difference between life and death in the event that abandonment of a sailboat or other type of primary boat or yacht becomes necessary. By "dinghy" is meant any type of relatively small runabout, tender, or life raft designed to be used on its own, or carried on or pulled behind a larger sailboat, yacht, or other type of vessel. The larger vessel that pulls or carries the dinghy is called here the "primary" vessel. The dinghy is preferably inflatable. If the primary boat capsizes, for example, its occupants can board the dinghy, cut the line, and push off from the sinking primary vessel.

Besides protecting the dinghy's occupants, the brightly colored cover 10 calls attention to itself and facilitates recovery of the dinghy. The cover 10 protects against spray from waves, which can be particularly important when the dinghy is in use in non-tropical waters. The cover 10 also protects the dinghy's occupants against cold ambient temperatures. Use of the cover 10 does not require redesign of the dinghy. It can be used on existing dinghies without alterations to the dinghies. The cover 10 fits neatly over the hull shape that is peculiar to most conventional dinghies, and is adaptable to fit a variety of dinghy lengths and widths. The cover 10 can be made in a small version for a two-person dinghy, or a large version for a ten-person dinghy, for example.

Referring to FIGS. 1 through 4, the cover 10 is comprised of a generally tent-shaped canopy 12 over an inflatable backbone support 13. In the preferred embodiment shown, the canopy 12 is comprised of: a central canopy portion 14 having side edges for contacting the sides of the dinghy 11; a forward canopy portion 15 affixed to one side of the central canopy portion 14; and an aft entrance portion 16 affixed to an opposite side of the central canopy portion 14.

Figure 3:
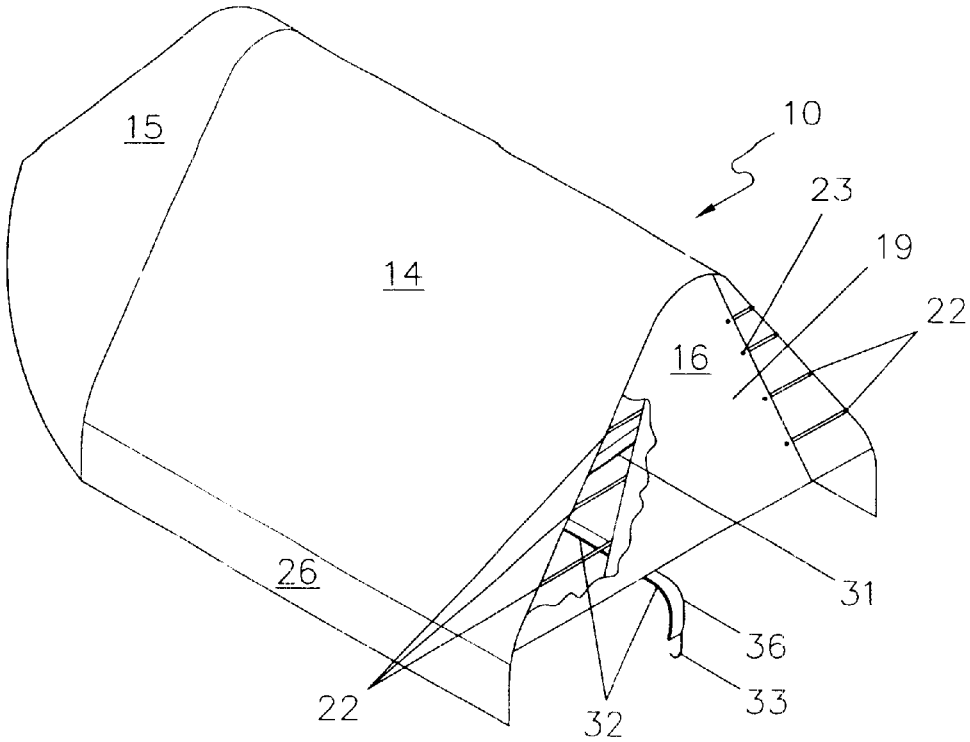
FIG. 3 is a rear perspective view of the dinghy cover according to FIG. 2, shown with a rear cut-away.
Figure 4:
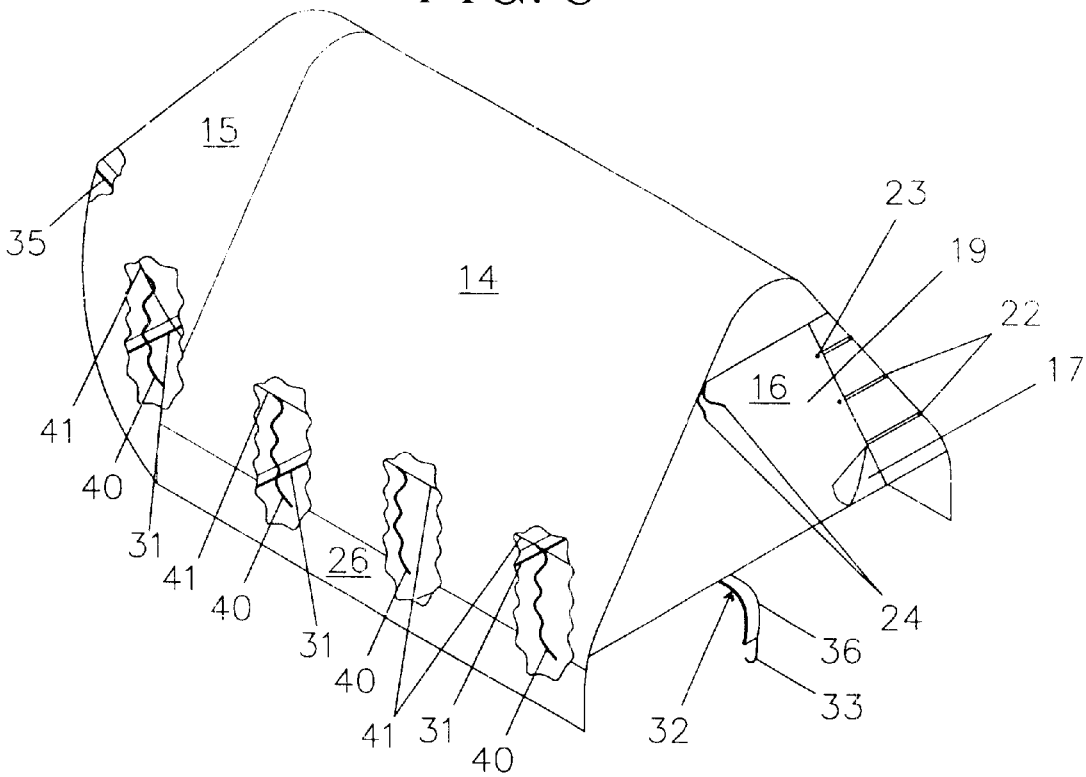
FIG. 4 is a rear perspective view of an alternate embodiment of a dinghy cover according to the present invention, shown with side cut-aways.

Beginning at the rear of the canopy 12, the aft entrance portion 16 comprises an opening 17 to an interior 18 of the canopy 10 and the dinghy 11 (see FIG. 4). The entrance is at the rear of the dinghy for easy ingress and egress in breaking seas. The door opening 17 is covered by a door flap 19, which is shown in FIGS. 1–4. The cover 10 does not interfere with the floor space in the dinghy 11. Inside the dinghy, the occupants sit on the dinghy floor or on seats 20 or inflatable thwarts in the dinghy., The canopy 10 fits over dinghies with or without row locks 21 (see FIG. 2), with or without interior seats (e.g., Fiberglass seat 20 or inflatable thwart), and with or without boat steering (including a steering wheel). The door flap 19 is fastenable to door flap ties 22 or other suitable fastening devices on an opposite side of the aft entrance portion (see FIG. 4) for ventilation and visibility behind the dinghy. Hook and loop strips can be used for fastening the door flap closed. The door flap ties 22 are threaded through spaced apart grommets 23 sewn in a vertical line along an edge of the flap 19, as shown in FIGS. 3 and 4. There is also a row of grommets (not shown) sewn into the edge of the starboard door flap portion that extends behind the flap shown. As can be seen in the cut-away in FIG. 3, the starboard flap portion is held shut by straps 22 in the same way that the port, outer flap 19 is held closed. The door flap 19 can be tied open by means of a door lashing 24 or other fastening device to hold the entrance open. Hook and loop strips may be utilized as any attachment means herein. The edge of the generally triangular-shaped aft entrance portion 16 is sewn or otherwise suitably affixed to a rear edge of the central canopy portion 14 at first seam 25, which falls in a generally vertical direction when the cover is in use.

Continuing with FIGS. 1–4, the generally rectangular-shaped central portion 14 in the middle of the canopy 12 includes two side borders 26, one along each opposite, bottom side edge of the central portion. The generally rectangular-shaped side borders 26 are sewn or otherwise suitably attached along a longitudinal side edge of each border to the remainder of the central canopy portion at second seams 27, which are in a generally horizontal direction when the cover is in use.

The cover 10 is removably attachable over the hull of the dinghy 11. The forward canopy portion 15 fits over the bow 28 of the dinghy (see FIG. 2). In many dinghy models, the bow is lifted slightly off the surface of the water. Although a lifted bow facilitates placement of the forward canopy portion 15 of the canopy 10 over the dinghy, the canopy can easily be placed over a variety of bow shapes. The forward canopy portion 15 is generally triangular in shape. A forward edge of the central canopy portion 14 is sewn or otherwise attached to a rear edge of the forward canopy portion at third seam 29. Third seam 29 is generally vertically oriented when the cover is in use. The rear end of second seam 27 ends at first seam 25, and its opposite, front end intersects third seam 29. The second seams 27 are perpendicular to the first seam 25 and the third seam 29, which are generally parallel to one another.

Referring to FIGS. 1 and 3–6, a system of straps 30 holds the cover 10 closely on the hull of the dinghy 11. The strap system 30 comprises a plurality of spaced-apart connector straps 31, which connect the edges of the central portion of the canopy to one another across the bottom of the dinghy. One end of each of the connector straps 31 is attached, as by sewing, to the lower edge of one side border 26 along the central canopy portion 14. An opposite end of the connector straps 31 is detachably attachable to the lower edge of the opposite side border 26. The connector straps 31 are preferably evenly spaced apart and made of a durable, elasticized material, so that they hold the cover 10 firmly on the dinghy hull.

The cover 10 is adapted to fit over the hull of the dinghy 11, with the canopy 12 over the top of the dinghy and the strap system 30 extending across the bottom of the dinghy 11. The cover 10 is versatile in that it can fit various types and sizes of dinghy. In a narrow dinghy model, the lower edges of the side borders 26 extend down slightly below the water line on the dinghy side hulls when the cover 10 is in use, as shown in FIG. 1. In dinghy models having a wider hull, the connector straps 31 will be stretched more tautly across the bottom of the dinghy, and the lower edges of the side borders 26 will be pressed along the side hulls above the water line.

Figure 5:
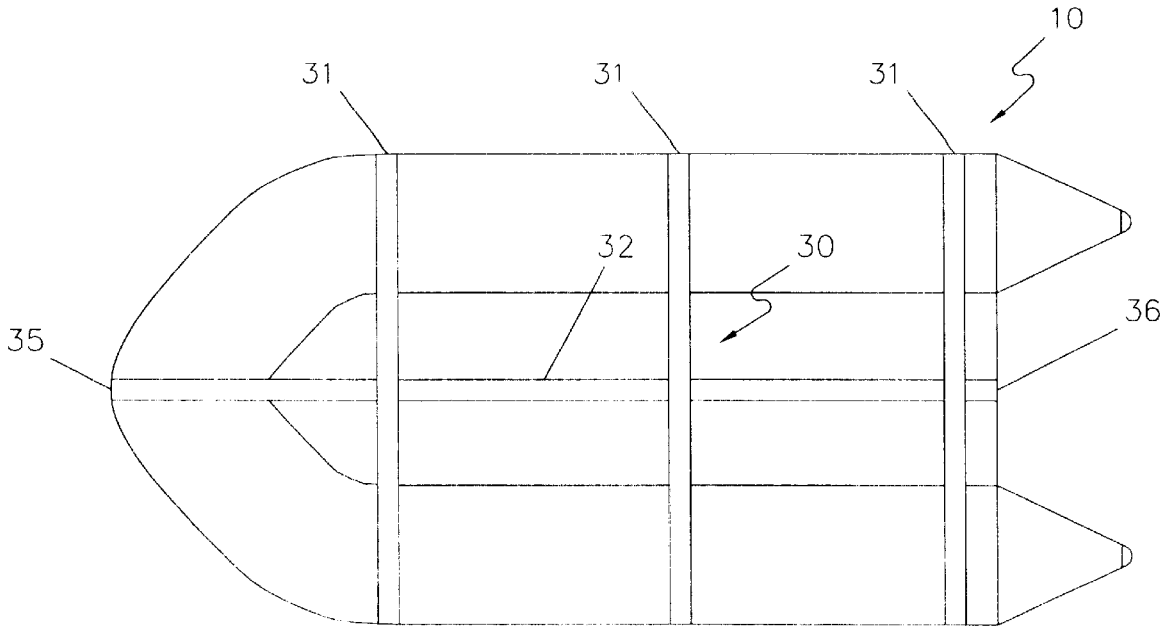
FIG. 5 is a bottom plan view of a dinghy cover according to FIG. 4.

As shown in FIG. 5, the strap system 30 most preferably includes three latitudinally-oriented ones of the connector straps 31, and one longitudinally-oriented main strap 32. One end of each of the main strap 32 is attached, as by sewing, to the approximate centerpoint of the lower edge of the forward canopy portion 15. An opposite end of the main strap 32 is attached to an attachment means, such as a hook 33. When the cover 10 is in use, the user reaches over the stem of the dinghy, pulls up the dangling end of the main strap 33, and attaches the hook 33 or the other attachment means, up over the stem board 34 or other structure at the stem of the dinghy 11. If the dinghy has an outboard engine, the end of the preferably elasticized main strap 32 is pulled to the port or starboard of the engine. The main strap 32 is preferably woven through or attached to the centerpoint of the connector straps 31 where the two straps cross, as shown in FIG. 5, so that the end of the main strap 32 is easier to grasp from the stern of the dinghy. The strap system 30 herein may include any number of straps. An additional connector strap 31 at the bow is shown in FIG. 1.

Figure 6:
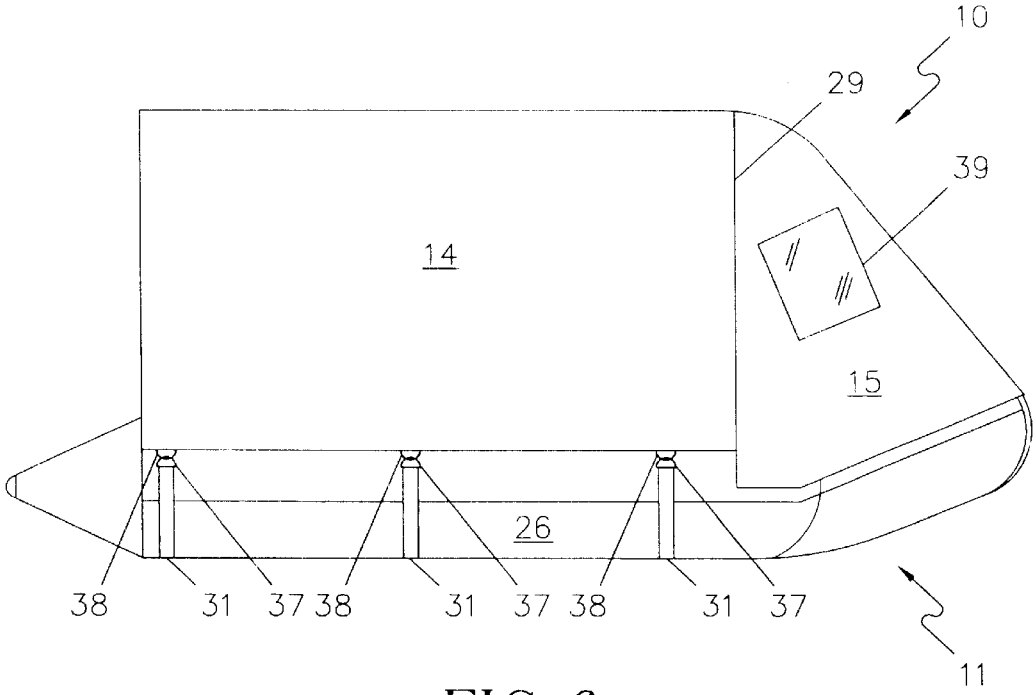
FIG. 6 is a side elevational view of an alternate embodiment of a dinghy cover according to the present invention.

Thus, in the preferred embodiment of FIG. 6, the strap system 30 comprises at least one main, longitudinally-oriented main strap 32, and at least three of the connector straps 31, which are parallel to one another and latitudinally-oriented. In this preferred embodiment, the main strap 32 crosses over a centerpoint of each of the connector straps 31. The main strap 32 has a front end 35 attached to an approximate centerpoint of a lower edge of the aft canopy portion, as shown in FIGS. 4 and 6, and an opposite, rear end 36 attached to a means for detachably attaching the main strap 32 to the dinghy 11, as shown in FIGS. 1–4. The preferred means for detachably attaching the main strap is a hook 33 attachable to a stern of the dinghy 11. Also, each of the connector straps 31 is affixed at one of its ends to a lower edge of one side border 26 of the canopy, as shown in FIG. 1, and at an opposite one of its ends to a means for detachably attaching the connector strap to a lower edge of an opposite side border of the canopy, as shown in FIG. 6. The means for detachably attaching the connector strap is preferably a carabiner 37. As shown in FIG. 6, the cover 10 further comprises a plurality of receiving loops 38, which are attached to the outside face of the opposite side border 26 of the canopy 12. Each carabiner 37 is attachable to one of the receiving loops 38. This embodiment includes a transparent forward window 39 incorporated into the forward canopy portion 15 for forward visibility.

Referring to the cut-aways shown in FIG. 4, the cover 10 further includes spaced-apart string ties 40 or an alternate fastening device, for tying the inside of the canopy 12 to a tie hold in the dinghy 11. One end of each string tie 40 is preferably sewn in a series into a straight, interior seam 41 along the inside of the canopy 12. String ties 40 in the area of the oar locks 21 (also see FIG. 2) can be fastened around the dinghy's oar locks, for example, or any other suitable location (such as handles or seats in the dinghy) along the inside of the dinghy, to help hold the cover 10 on the dinghy 11. In an emergency situation, such as wind-whipped seas or a serious injury, it may not be possible at first to fasten the strap system 30 under the dinghy's hull. In that case, the string ties 40 should be fastened immediately to hold the cover 10 on the dinghy 11 until weather conditions permit also fastening the strap system 30 under the dinghy.

Figure 2:
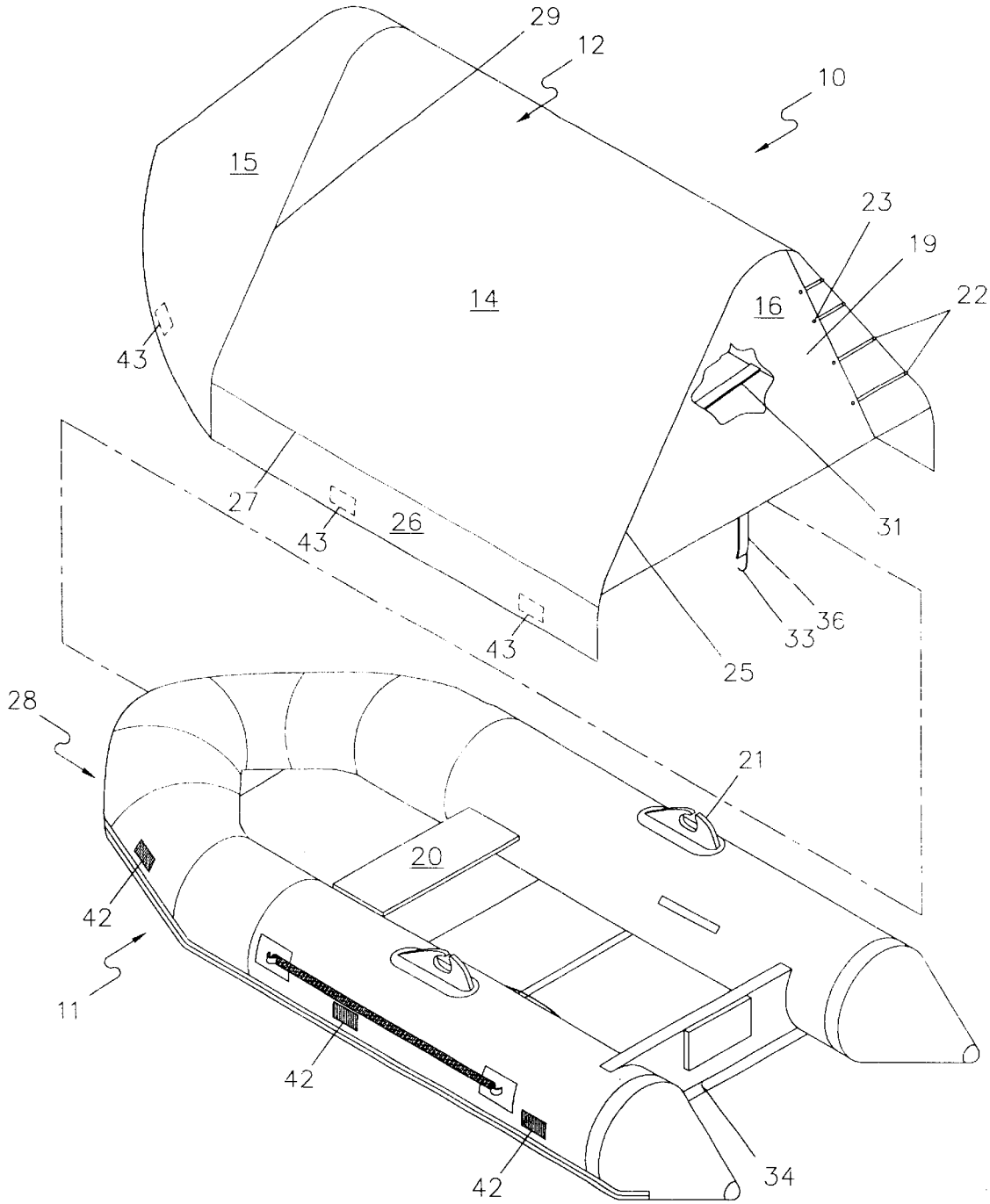
FIG. 2 is a rear perspective view of the dinghy cover according to FIG. 1, shown above a dinghy.

Another alternative in the event that bad weather conditions or another emergency prevents fastening the strap system 30 under the dinghy hull is a system of hook and loop patches 42 along the dinghy hull, as shown in FIG. 2. Corresponding patches of hook and loop 43 affixed (preferably sewn) to the inside face of the canopy 12 along its lower edge can be pressed onto the hook and loop patches 42 on the hull to fasten the cover 10 to the dinghy 11. This line of hook and loop patches 42, 43 can be used instead of, but is preferably used in addition to, the strap system 30 and string ties 40.

Turning now to FIGS. 7–11, the cover 10 further comprises an inflatable support 44 backbone for supporting the canopy 10. The inflatable support 44 comprises at least one enclosed, inflatable, central support tube 45 and an air valve 46 in the support tube for inflating it.

In the preferred embodiment illustrated in FIGS. 7–11, the canopy support 44 comprises:

(a) at least one central support tube 45, a front portion 47 of which is angled in a generally downward direction at an angle of between about 35 and 55 degrees; and (b) at least two pairs of matching leg tube portions 48, each having one end continuous with the central tube, the leg tube portions 48 being angled in a generally downward direction from the central support tube 45 at an angle of between about 35 and 55 degrees, a rear pair 49 of the leg tube portions projecting from opposite sides of an end of the central support tube 45, a front pair 50 of the leg tube portions projecting from opposite sides of a midportion of the central support tube 45. At least one of the air valves 46 is affixed in a wall of the support.

Figure 8:
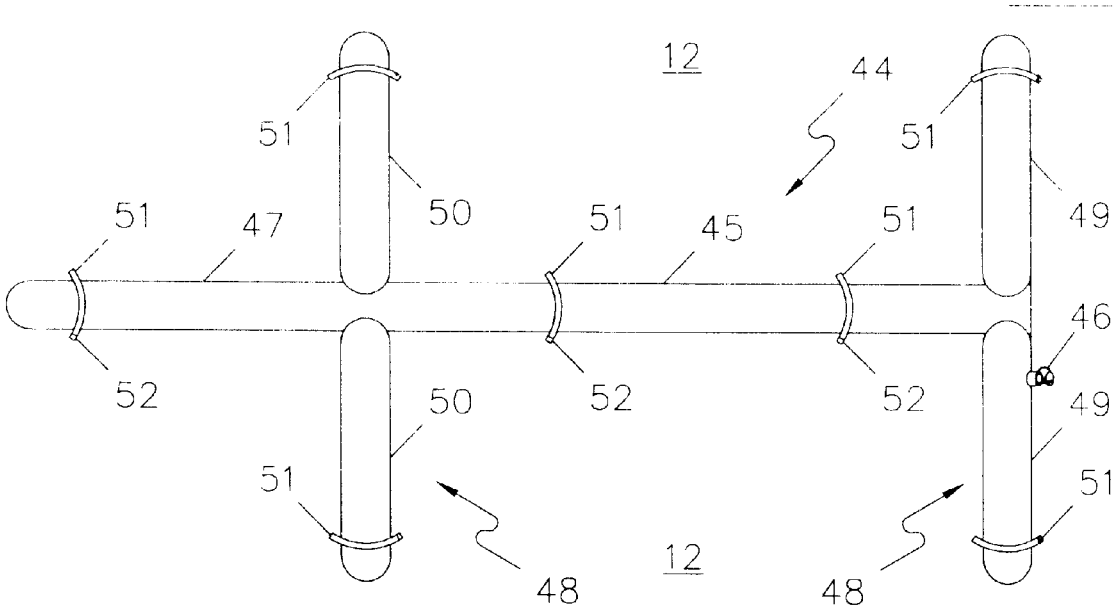
FIG. 8 is a bottom plan view of the inflatable support according to FIG. 7, shown attached to the canopy ceiling by straps.
Figure 9:
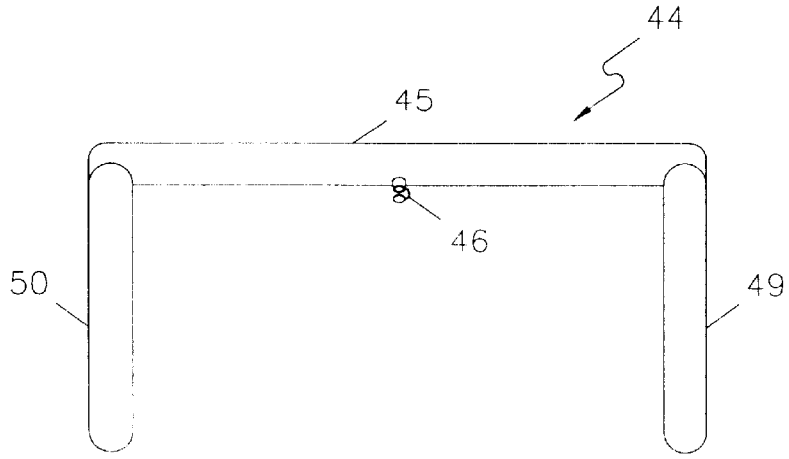
FIG. 9 is a side elevational view of an alternate embodiment of an inflatable support of a dinghy cover according to the present invention.

As shown from beneath the canopy in the bottom plan view of FIG. 8, the inflatable canopy support 44 can be attached to a central portion of the canopy 12 by spaced-apart canopy straps 51 having at least one end detachably attached by corresponding hook and loop strips 52 or other attachment means to an inside face (the ceiling) of the canopy 12. The canopy straps 51 support the lightweight central support tube 45. In FIG. 8, seven flexible canopy straps 51 are shown, three of them across the central support tube 45 and two of them across each leg tube portion 48.

Figure 12:
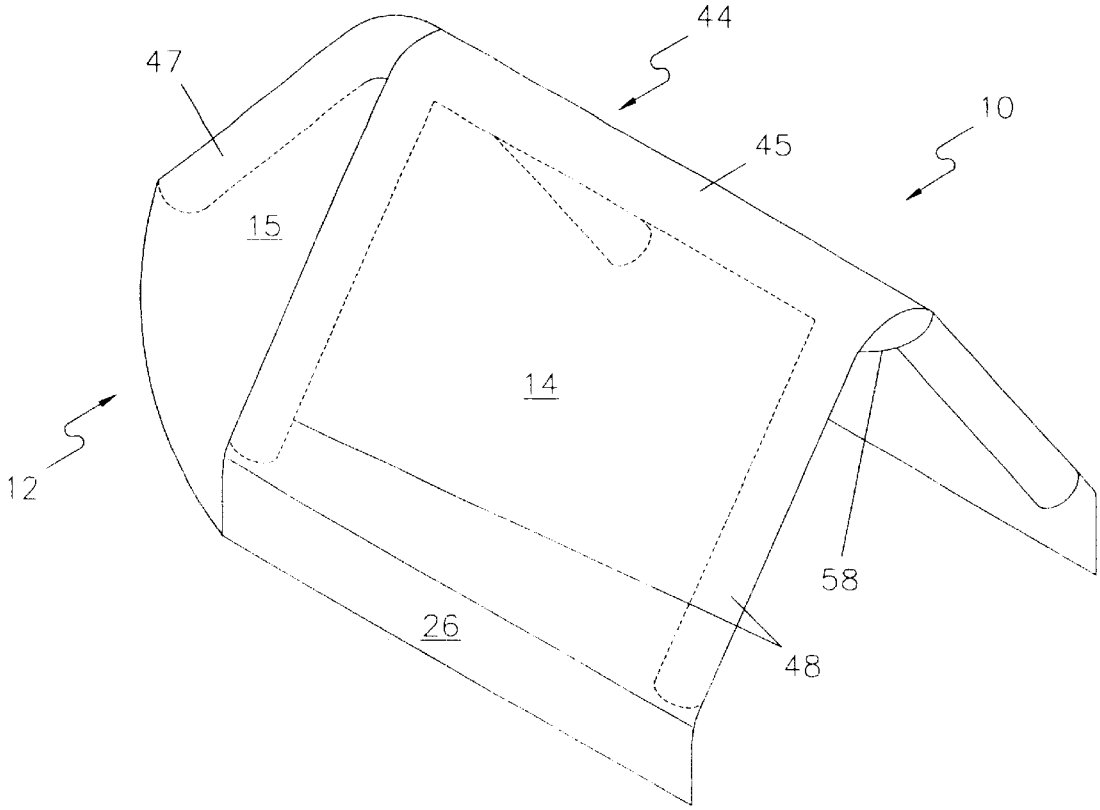
FIG. 12 is a perspective view of an alternate embodiment of a dinghy cover according to the present invention, shown without an aft entrance portion.

The inflatable support 44 can alternatively be affixed to the canopy ceiling by sliding the central support tube 45 through generally rectangular-shaped pieces of material sewn to the canopy ceiling along the edges of the piece. The piece of material is seamed on its two opposite longitudinal side edges, with the support tube 45 being supported by the piece. A third alternative, which is shown in FIG. 12, is for the piece of material to itself form the air-tight inflatable tube or system of tubes. Once it is inflated, the canopy support 44 is buoyant, which is a feature that can help the covered dinghy right itself in the event it capsizes.

Figure 10:
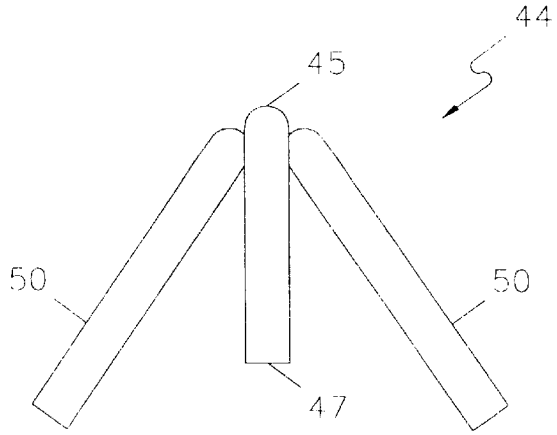
FIG. 10 is a front elevational view of an inflatable support of a dinghy cover according to the present invention.
Figure 11:
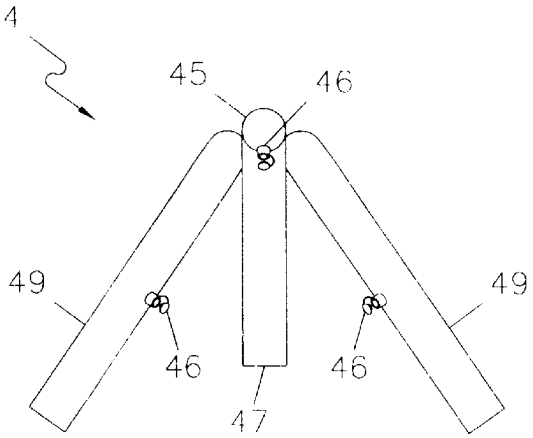
FIG. 11 is a rear elevational view of the inflatable support according to FIG. 10.

FIGS. 10 and 11 show front and rear views, respectively, of inflatable supports 44. For added protection, the support 44 may include two or more separate chambers, in case one chamber develops a leak. Patches are also included in the kit in case such a leak develops. Either support chamber when inflated can support the weight of the canopy. In FIGS. 10 and 11, five separate air chambers (tubes) are shown, with each leg tube portion 49, 50 being a separate chamber (total of four), and the central support tube 45 being a separate chamber. A separate air valve 46, such as an air valve in a valve stem with a screw-off cap, may lead to each tube wall.

Figure 7:
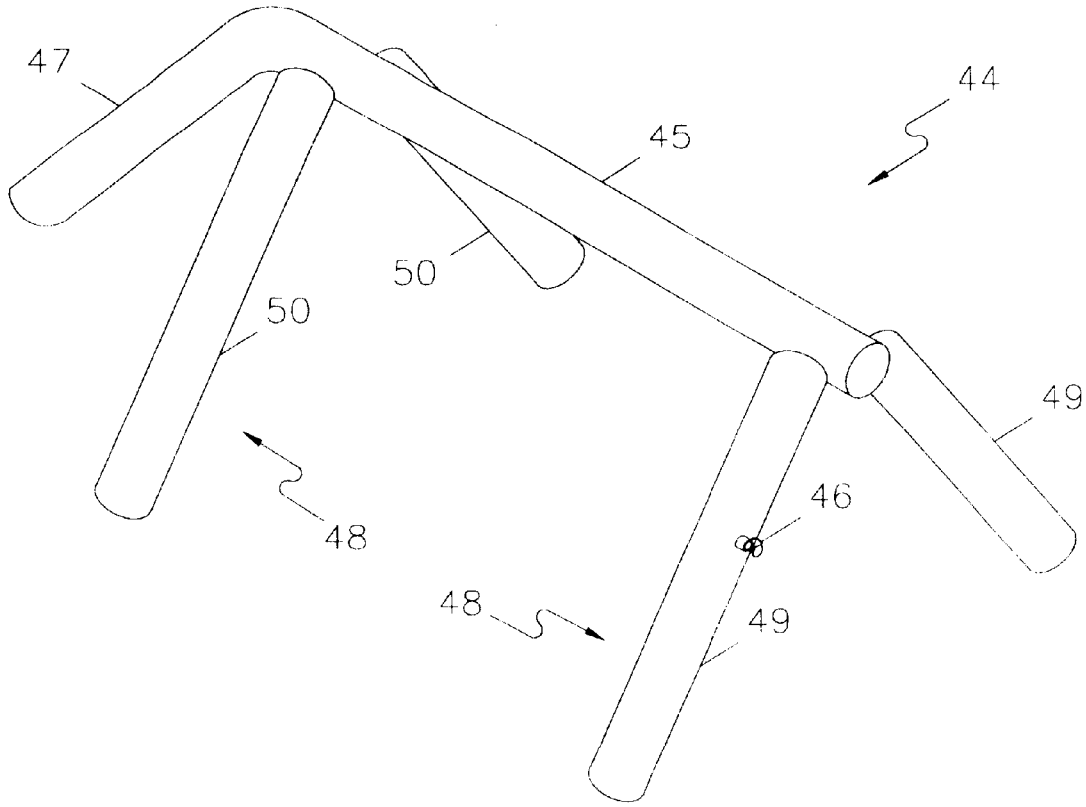
FIG. 7 is a rear perspective view of an inflatable support of a dinghy cover according to the present invention.

The inflatable support 44 shown in FIG. 7 supports the canopy 12 as shown, for example, in FIG. 1, and enables rapid deployment of the cover 10. The support valve 46 may be connected to a conventional pump, such as a foot pump, for pumping air into the tube(s) of the support. Alternatively, a user can blow air into the support valve 46. The air valve 46 is located in a wall of a support tube, preferably where it is easily accessible to the user. Alternatively, a 20 to 30 second inflation sequence makes the canopy 10 self-erecting. In the latter case, a gas canister connected to the support valve 46 can be activated by pulling a string pull. This forces gas into the support tube 45, deploying the canopy 10 in seconds. The support 44 may include two support valves 46, one for connection to a foot pump and a second valve 46 for manual inflation.

The cover 10 can be erected before or after the occupants enter the dinghy 11. If a primary vessel capsizes very quickly, for example, a user can enter the dinghy 11 and launch it, and then deploy the cover 10, which is ideally stored in its storage pouch within the dinghy.

FIG. 12 shows a support 44 for an alternate embodiment of a cover 10. Here, a section 58 of air-tight material is seamed to the inside face of the canopy 12 to itself form the inflatable support tube or system of tubes. After the edges of the section 58 are welded or otherwise fused to the inside face of the canopy 12 during manufacture, the space between the section 58 and the canopy 12 is filled with air or another gas, either during manufacture or by a user through an air valve in the support 44. Thus, the support 44 is part of the canopy 12 in this embodiment. The weld lines are indicated by dashed lines in FIG. 12. The opposite side of the cover is the same as the side shown. For purposes of illustration, the cover 10 in FIG. 12 is shown without its aft entrance portion.

The canopy 12 is preferably made of a brightly colored nylon material. The canopy is preferably International Orange, which has high visibility on the open seas. The canopy 12 is preferably made of a sturdy, durable nylon capable of withstanding adverse weather conditions. The canopy support tube is preferably made of a heavy, durable rubber or rubber-like material (or neoprene) that is capable of retaining air in the support tube over time.

Even with the cover 10 on, a dinghy can provide a stable ride. The erect cover does not interfere with handling of the dinghy. The cover 10 does not take up valuable dinghy floor space. Its presence and bright color, as well as optional lights and reflective tape on the exterior of the canopy, provide good visibility for attracting rescue and guarding against collisions with other vessels. The cover can be erected on land, or in the water. A user can erect the cover while standing or kneeling on the deck of the primary vessel, or while sitting in the dinghy. The cover can be assembled and disassembled quickly by one person.

To use the cover 10, a user first fits the cover 10 over the dinghy hull, beginning with fitting the forward canopy portion 15 over the bow. Second, the user moves to the side of the dinghy and snaps the carabiners 37 or other attachment means at the ends of the connector straps 31 over the loops 38, or other suitable receiving means, on the lower edge of the central canopy portion 14. Third, the user inflates the inflatable canopy support 13. The user could alternatively inflate the inflatable support prior to fastening the strap system 30. Fourth, the user moves to the dinghy's stern, where he or she grasps the hook 33 or other attachment means at the end of the main strap 32 and fastens it on an appropriate hold at the stem. The user could alternatively fasten the main strap 32 before fastening the connector straps 31. Fifth, from inside the dinghy, the user fastens the string ties 40 to tie holds in the dinghy 11.

Figure 13:
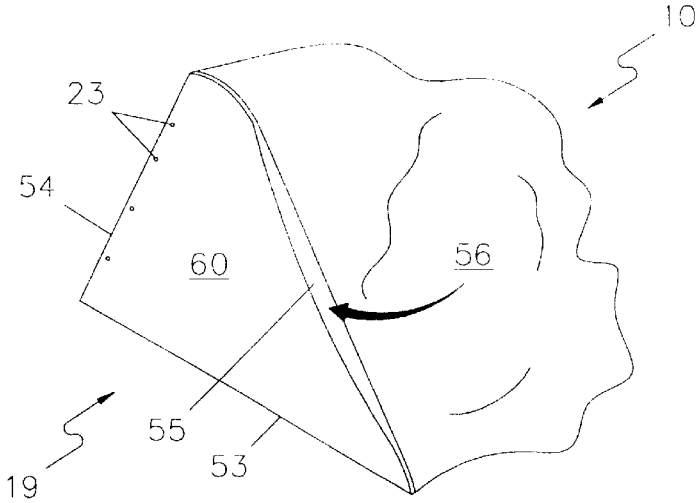
FIG. 13 is a perspective view of a dinghy cover according to the present invention, shown being folded into a storage pouch.

Referring to FIG. 13, importantly, the canopy 10 can be stowed where it is easily accessible in the event of an emergency. The canopy is foldable into a compact, attached storage pouch. The storage pouch can be easily stowed aboard the dinghy, in a boat locker, in the trunk of a car, etc.

Figure 14:
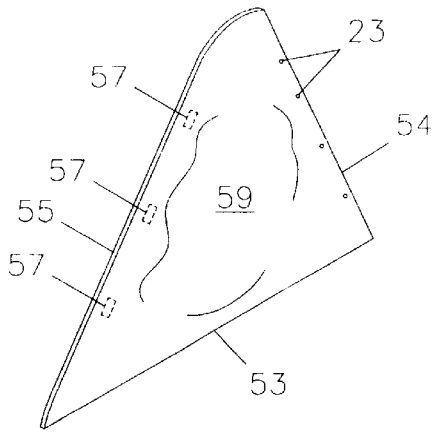
FIG. 14 perspective view of a stowable storage pouch according to FIG. 13.

In the embodiment shown in FIGS. 13 and 14, the door flap 19 is the storage pouch. The remainder 56 of the deflated cover can be stored in the door flap 19 when the cover is deflated and not in use. The generally triangular-shaped door flap 19 has a front wall 59, shown in FIG. 13, and a rear wall 60, shown in FIG. 14, which are connected together (as by sewing) on two adjoining side edges 53, 54. The front flap wall 59 is connected on its third side to an edge of a central portion 14 of the canopy 12. The rear flap wall 52 is not connected on its third side, forming an opening between the inside faces of the rear flap wall and the front flap wall. The reminder of the conformable cover 56 can be crumpled up compactly and inserted through the pouch opening 55 into the pouch in the door flap 19. The canopy 12 is preferably made of a highly conformable, lightweight nylon material. In FIG. 13, the remainder of the cover is shown folded or crumpled up for insertion into the door flap 19, which is the storage pouch. The grommets 23 are shown along one side of the door flap 19. The pouch can be closed by means of hook and loop strips 57 attached to the inside edges of the front and rear flap walls along the opening 55, as shown in FIG. 14.

From the foregoing it can be realized that the described device of the present invention may be easily and conveniently utilized as a cover for protecting occupants of a dinghy on the water. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An easily inflated vessel cover for protecting occupants of a small vessel on the water, the cover comprising:

(a) a flexible canopy comprised of a central canopy portion having side edges for contacting opposite sides of the vessel, a forward canopy portion having a lower edge for contacting a bow of the vessel, the forward canopy portion extending from one side of the central canopy portion, and an aft entrance portion connected to an opposite side of the central canopy portion; the aft entrance portion comprising an opening to an interior of the vessel;

(b) a system of spaced-apart, flexible straps attachable across a bottom of the vessel for affixing the cover to the vessel, the strap system comprising at least one connector strap, the connector strap being detachably or permanently attached at its ends to two, opposite, lower edges of the canopy; and (c) at least one inflatable central support for supporting the canopy over the vessel interior, the inflatable support comprising at least one enclosed, inflatable support tube and an air valve in the support tube for inflating the support tube; and wherein the inflatable support tube lies beneath and adjacent to a portion of the canopy, and the cover is removably attachable over the bow and sides of the vessel.

2. A cover according to claim 1, further comprising (d) a plurality of spaced-apart ties, each being affixed at one end to an inside face of the canopy for tying the canopy to a tie hold in the vessel.

3. A cover according to claim 2, wherein the inflatable support comprises:

(a) a central one of the inflatable support tubes, a front portion of which is angled in a generally downward direction at an angle of between about 35 and 55 degrees from the remainder of the central support tube; and (b) at least two pairs of matching leg tube portions, each having an upper end continuous with the central tube, the leg tube portions being angled in a generally downward direction from the central support tube at an angle of between about 35 and 55 degrees, a rear pair of the leg tube portions projecting from opposite sides of an end portion of the central support tube, a front pair of the leg tube portions projecting from opposite sides of a midportion of the central support tube;

wherein at least one of the air valves is affixed in a wall of one of the inflatable support tubes.

4. A cover according to claim 3, wherein the central canopy portion comprises a side border affixed to each of its two side edges, an end of each of a plurality of the straps being connected to one of the two side borders, an opposite end of each of the straps being detachably connected to an opposite one of the two side borders.

5. A cover according to claim 4, wherein the strap system comprises at least one longitudinally-oriented main strap; and at least three of the connector straps, which are parallel to one another and latitudinally-oriented; the main strap crossing over or under the connector straps.

6. A cover according to claim 5, wherein the main strap has a front end affixed to an approximate centerpoint of a lower edge of the forward canopy portion, and an opposite, rear end attached to a first means for detachably attaching the main strap to a portion of the vessel.

7. A cover according to claim 5, wherein each of the connector straps is affixed at one of its ends to a lower edge of one side border of the canopy, and at an opposite one of its ends to a means for detachably attaching the connector strap to a lower edge of an opposite side border of the canopy.

8. A cover according to claim 7, further comprising a plurality of receiving loops attached to the opposite side border of the canopy; and wherein the means for detachably attaching the connector strap is a carabiner, each carabiner being attachable to one of the receiving loops.

9. A cover according to claim 3, wherein the inflatable support is attached to a central portion of the canopy by spaced-apart canopy straps, the canopy straps having at least one end attached to an inside face of the canopy, the canopy straps encircling the central support tube.

10. A cover according to claim 3, wherein the aft entrance portion further comprises a door flap extending over the aft opening, the door flap being fastenable to a door fastening means on the aft entrance portion.

11. A cover according to claim 10, wherein the door fastening means is comprised of a door flap tie attachable to a grommet, the grommet being affixed to an edge of the door flap, one end of each door flap tie being attached to an opposite side of the aft entrance portion of the canopy.

12. A cover according to claim 3, further comprising a plurality of hook and loop patches affixed to a lower edge of an inside face of the canopy, each patch corresponding to a hook and loop patch affixed to a hull of the vessel.

13. A cover according to claim 12, wherein the inflatable support is rapidly inflatable by means of a gas canister connectable to the air valve.

14. A cover according to claim 2, wherein the edges of a section of a material are fused to an inside face of the canopy, forming an inflatable support tube between the surface of the material and the inside face of the canopy.

15. A cover according to claim 2, wherein the door flap is a generally triangular-shaped storage pouch for storing the remainder of the deflated cover, the door flap having a front wall and rear wall connected together along their two adjoining side edges and forming a pouch, the front wall being connected on its third side edge to an edge of a central portion of the canopy, the rear wall being open on its third side, the remainder of the cover being insertable through the opening into the pouch.

* * * * *